US009404209B2

(12) United States Patent
Kim et al.

(10) Patent No.: US 9,404,209 B2
(45) Date of Patent: Aug. 2, 2016

(54) LAUNDRY MACHINE

(75) Inventors: Soo Bong Kim, Changwon-si (KR); Ig Geun Kwon, Changwon-si (KR); Young Suk Kim, Seoul (KR); Hyun Seok Seo, Seoul (KR); Min Gyu Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1031 days.

(21) Appl. No.: 13/320,676

(22) PCT Filed: May 27, 2010

(86) PCT No.: PCT/KR2010/003382

§ 371 (c)(1),
(2), (4) Date: Nov. 15, 2011

(87) PCT Pub. No.: WO2010/137897

PCT Pub. Date: Dec. 2, 2010

(65) Prior Publication Data

US 2012/0060566 A1 Mar. 15, 2012

(30) Foreign Application Priority Data

| | | |
|---|---|---|
| May 28, 2009 | (KR) | 10-2009-0047192 |
| Aug. 27, 2009 | (KR) | 10-2009-0079829 |
| Aug. 27, 2009 | (KR) | 10-2009-0079909 |
| Aug. 27, 2009 | (KR) | 10-2009-0079950 |
| May 18, 2010 | (KR) | 10-2010-0046455 |

(51) Int. Cl.
*D06F 25/00* (2006.01)
*D06F 37/22* (2006.01)
(Continued)

(52) U.S. Cl.
CPC ..... *D06F 37/22* (2013.01); *D06F 25/00* (2013.01); *D06F 37/206* (2013.01); *D06F 37/262* (2013.01); *D06F 37/263* (2013.01); *D06F 37/264* (2013.01); *D06F 37/267* (2013.01); *D06F 37/268* (2013.01); *D06F 37/269* (2013.01)

(58) Field of Classification Search
CPC ..... D06F 25/00
See application file for complete search history.

(56) References Cited

U.S. PATENT DOCUMENTS

| | | | | |
|---|---|---|---|---|
| 2,579,472 | A | 12/1951 | Chamberlin et al. | 68/24 |
| 2,836,046 | A | 5/1958 | Smith | 68/24 |
| 3,022,656 | A | 2/1962 | Bergeson et al. | 68/207 |

(Continued)

FOREIGN PATENT DOCUMENTS

| | | | |
|---|---|---|---|
| AU | 28020 77 | A | 2/1979 |
| CN | 1296536 | A | 5/2001 |

(Continued)

OTHER PUBLICATIONS

United States Office Action dated Aug. 7, 2014 issued in U.S. Appl. No. 13/258,732.

(Continued)

*Primary Examiner* — Jason Ko
(74) *Attorney, Agent, or Firm* — KED & Associates LLP

(57) ABSTRACT

A laundry machine is disclosed. The laundry machine includes a tub configured to receive wash water, a drum rotatably installed in the tub, a shaft connected with the drum, a bearing housing (400) configured to support the shaft, a tub back (130) coupled to inner and outer circumferences of a front surface of the bearing housing (400), a rear gasket connected between the tub back (130) and the tub and a suspension unit configured to support vibration of the drum suspendingly.

17 Claims, 12 Drawing Sheets

(51) Int. Cl.
*D06F 37/20* (2006.01)
*D06F 37/26* (2006.01)

(56) References Cited

U.S. PATENT DOCUMENTS

| | | | | |
|---|---|---|---|---|
| 3,038,639 | A | 6/1962 | Anderson | 222/70 |
| 3,066,522 | A | 12/1962 | Steinmüller | 68/24 |
| 3,089,326 | A | 5/1963 | Belaieff | 68/24 |
| 3,385,085 | A | 5/1968 | Engel | 68/18 |
| 3,854,733 | A | 12/1974 | Wilson | 277/82 |
| 5,105,636 | A | 4/1992 | Anastase et al. | |
| 5,353,613 | A | 10/1994 | Smith et al. | |
| 5,860,300 | A | 1/1999 | Valent | 68/24 |
| 6,148,647 | A | 11/2000 | Kabeya et al. | 68/140 |
| 6,354,115 | B1 | 3/2002 | Zahn | |
| 7,536,882 | B2 | 5/2009 | Kim et al. | 68/24 |
| 7,571,625 | B2 | 8/2009 | Chang | 68/24 |
| RE41,621 | E | 9/2010 | Kim et al. | |
| 2003/0121294 | A1 | 7/2003 | Ryu et al. | |
| 2004/0123631 | A1 | 7/2004 | Chang | 68/23.1 |
| 2004/0163426 | A1 | 8/2004 | Kim et al. | 68/23 |
| 2005/0274159 | A1 | 12/2005 | Jeon et al. | 68/23.1 |
| 2006/0016228 | A1 | 1/2006 | Chang et al. | |
| 2006/0191302 | A1 | 8/2006 | Kim et al. | |
| 2006/0196233 | A1 | 9/2006 | Kim et al. | |
| 2006/0254321 | A1 | 11/2006 | Lim et al. | 68/12.01 |
| 2007/0017261 | A1 | 1/2007 | Chang et al. | 68/23.1 |
| 2007/0137260 | A1 | 6/2007 | Shikamori et al. | |
| 2007/0227200 | A1 | 10/2007 | Kim et al. | |
| 2007/0277559 | A1 | 12/2007 | Compains et al. | |
| 2008/0067879 | A1 | 3/2008 | Kim et al. | |
| 2008/0307833 | A1 | 12/2008 | Chang et al. | 68/23.1 |
| 2009/0044574 | A1 | 2/2009 | Lim et al. | |
| 2009/0107187 | A1 | 4/2009 | Kim et al. | 68/140 |
| 2009/0113943 | A1* | 5/2009 | Lee | 68/140 |

FOREIGN PATENT DOCUMENTS

| | | | |
|---|---|---|---|
| CN | 1511997 | A | 7/2004 |
| CN | 1707010 | A | 12/2005 |
| CN | 1724742 | A | 1/2006 |
| CN | 1932126 | A | 3/2007 |
| CN | 1940166 | A | 4/2007 |
| CN | 101046046 | A | 10/2007 |
| CN | 201187000 | Y | 1/2009 |
| DE | 297 16 968 | U1 | 11/1997 |
| EP | 0 414 298 | A1 | 2/1991 |
| EP | 0 655 523 | A1 | 5/1995 |
| EP | 0 874 078 | A2 | 10/1998 |
| EP | 1 040 257 | A1 | 10/2000 |
| EP | 1 079 014 | A1 | 2/2001 |
| EP | 1 094 144 | A2 | 4/2001 |
| EP | 1 433 890 | A2 | 6/2004 |
| EP | 1 433 891 | A2 | 6/2004 |
| EP | 1 445 368 | A2 | 8/2004 |
| EP | 1 605 088 | A2 | 12/2005 |
| EP | 1 688 531 | A1 | 8/2006 |
| EP | 1 746 192 | A2 | 1/2007 |
| EP | 1 770 199 | A2 | 4/2007 |
| EP | 1 840 257 | A1 | 10/2007 |
| EP | 1 881 099 | A1 | 1/2008 |
| EP | 1 619 286 | B1 | 8/2009 |
| FR | 2215503 | A1 | 8/1974 |
| GB | 2 029 862 | A | 3/1980 |
| GB | 2 174 513 | A | 11/1986 |
| JP | 2006-068273 | A | 3/2006 |
| JP | 2008-194090 | A | 8/2008 |
| KR | 10-2005-0093253 | A | 9/2005 |
| KR | 10-2006-0009075 | A | 1/2006 |
| KR | 10-0610666 | B1 | 2/2006 |
| KR | 10-2006-0044117 | A | 5/2006 |
| KR | 10-0651853 | B1 | 11/2006 |
| RU | 1772266 | A1 | 10/1992 |
| SU | 988691 | | 1/1983 |
| WO | WO 2008/069607 | A2 | 6/2008 |
| WO | WO 2008/099551 | A1 | 8/2008 |
| WO | WO 2008/103007 | A2 | 8/2008 |

OTHER PUBLICATIONS

Russian Decision to Grant a Patent dated Sep. 11, 2014 issued in Application No. 2011153799.
United States Office Action dated Sep. 18, 2014 issued in U.S. Appl. No. 13/259,670.
Chinese Office Action dated Oct. 10, 2012 issued in Application No. 200980155600.2 (with English translation).
European Search Report dated Oct. 26, 2012 issued in Application No. 10 78 0809.
Mexican Office Action dated Feb. 13, 2014 issued in Application No. MX/a/2011/007091 (with English translation).
European Search Report dated Feb. 19, 2014 issued in Application No. 10 78 0818.
European Search Report dated Feb. 24, 2014 issued in Application No. 10 78 0807.
International Search Report dated Oct. 15, 2010 issued in Application No. PCT/KR2009/008003.
International Search Report and Written Opinion dated Oct. 27, 2010 issued in Application No. PCT/KR2010/003381.
International Search Report dated Nov. 24, 2010 issued in Application No. PCT/KR2010/003383.
European Search Report dated Aug. 1, 2012 issued in Application No. 09 83 6416.
Chinese Office Action dated Mar. 20, 2013 issued in Application No. 201080017292.X (with English Translation).
Chinese Office Action dated Mar. 25, 2013 issued in Application No. 201080021205.8 (with English Translation).
Chinese Office Action dated Mar. 28, 2013 issued in Application No. 201080020149.6 (with English Translation).
Chinese Office Action dated Mar. 28, 2013 issued in Application No. 201080021234.4 (with English Translation).
International Search Report and Written Opinion dated Sep. 13, 2010 issued in Application No. PCT/KR2009/007967.
International Search Report and Written Opinion dated Oct. 27, 2010 issued in Application No. PCT/KR2010/003402.
Russian Decision to Grant a Patent dated Aug. 29, 2013 issued in Application 2011132013 (with English translation).
International Search Report issued in PCT Application No. PCT/KR10/003382 dated Oct. 27, 2010.
U.S. Office Action dated May 29, 2015 issued in U.S. Appl. No. 13/142,633.
U.S. Office Action dated Nov. 17, 2014 issued in U.S. Appl. No. 13/142,633.
U.S. Office Action dated Nov. 20, 2014 issued in U.S. Appl. No. 13/259,626.
U.S. Final Office Action issued in U.S. Appl. No. 13/259,626 dated Apr. 9, 2015.
U.S. Office Action dated Apr. 23, 2015 issued in U.S. Appl. No. 13/259,670.

* cited by examiner

LAUNDRY MACHINE

CROSS-REFERENCE TO RELATED PATENT APPLICATIONS

This application is a U.S. National Stage Application under 35 U.S.C. §371 of PCT Application No. PCT/KR2010/003382, filed May 27, 2010, which claims priority to Korean Patent Application No. 10-2010-0046455, filed May 18, 2010, Korean Patent Application No. 10-2009-0079829, filed Aug. 27, 2009, Korean Patent Application No. 10-2009-0079950, filed Aug. 27, 2009, Korean Patent Application No. 10-2009-0079909, filed Aug. 27, 2009, and Korean Patent Application No. 10-2009-0047192, filed May 28, 2009.

TECHNICAL FIELD

The present invention relates to a laundry machine, more specifically, to a laundry machine which has an improved structure to improve washing efficiency.

BACKGROUND ART

Generally, laundry machines are electric appliances which remove various kinds of contaminants attached to clothes, beddings, cloth items and the like (hereinafter, laundry) by way of a friction force of water currents generated by rotation of a drum and a shock applied to laundry including clothes and the other items. A full-automatic laundry machine released in recent has a series of cycles including a washing, rinsing, dry-spinning cycle which are implemented automatically.

Instead of pulsator type laundry machine having a tub rotatable in a state of standing vertically, drum type laundry machines having little problems of entangled laundry and a lot of wrinkles generated in the laundry have been more and more popular recently.

As a structure of such a drum type laundry machine mentioned above is described schematically, the drum type laundry machine includes a cabinet configured to define an exterior appearance thereof, a tub located in the cabinet to receive wash water, with being supported by a damper an a spring, and a cylindrical drum located in the tub to receive laundry therein. The drum receives a driving force from a driving part to implement washing for the laundry loaded into the drum.

According to the structure of the drum type laundry machine mentioned above, the drum is rotated to wash and dry-spin the laundry loaded therein and it is vibrated because of the rotational force of the drum and eccentricity of the laundry. The vibration generated by the rotation of the drum may be transmitted outside via the tub and the cabinet.

Because of that, a spring and a damper are provided essentially between the tub and the cabinet to prevent the vibration transmitted to the tub from transmitted to the cabinet.

The drum type laundry machine mentioned above may be installed in an existing installation circumstance, for example, in a sink or built-in circumstance, not installed separately. As a result, the size of the drum type laundry machine may be installed limited to be adjustable to its installation circumstance.

As mentioned above, it is limited for the structure of the spring and damper dampening the vibration of the tub and the cabinet to change an inner structure of the drum type laundry. As the installation circumstance of the laundry machine is limited, it is limited to change the size of the laundry machine.

A lot of researches and developments have been in progress to improve washing capacities of laundry machines for user convenience and the increased washed laundry amount. However, it is difficult to enlarge the size of the tub in the conventional drum type laundry machine to increase the washing capacity, because of the limitation condition mentioned above.

As a result, laundry machines having various types of structures have been under development to improve the washing capacity as mentioned above.

DISCLOSURE OF INVENTION

Technical Problem

To solve the problems, an object of the present invention is to provide a drum type laundry machine having a new structure, different from the conventional laundry machine.

Solution to Problem

To achieve these objects and other advantages and in accordance with the purpose of the invention, as embodied and broadly described herein, a laundry machine includes a tub configured to receive wash water; a drum rotatably installed in the tub; a shaft connected with the drum; a bearing housing configured to support the shaft; a tub back coupled to inner and outer circumferences of a front surface of the bearing housing; a rear gasket connected between the tub back and the tub; and a suspension unit configured to support vibration of the drum suspendingly.

A through-hole may be formed in a center of the tub back to pass the shaft there through and a gentle curvature surface projected toward an inside of the tub may be formed in an outer circumference of the through-hole.

Coupling bosses coupled to the bearing housing may be formed in an outer circumference of the though-hole formed in a rear surface of the tub back.

Coupling holes in which the coupling bosses are inserted may be formed in the bearing housing.

First and second extending parts extended in a radial direction may be formed in the bearing housing and auxiliary coupling bosses coupled to the first and second extending parts of the bearing housing may be formed in an outer circumference of the rear surface of the tub back.

Auxiliary coupling holes in which the auxiliary coupling bosses are inserted may be formed in the first and second extending parts of the bearing housing, respectively.

Ribs configured to reinforce rigidity of the tub back may be formed in a rear surface of the tub back.

The ribs may include radial ribs formed in a center of the tub back in a radial direction and circular ribs alternatively provided with respect to the radial ribs.

An inserting rim part may be projected along an inner circumferential surface of the through-hole toward a front part of the tub back.

A bearing supporting part configured to support the shaft may be provided in the bearing housing and the inserting rim part may be inserted in an inner circumferential surface of the bearing supporting part.

A bearing supporting part configured to support the shaft and a middle rib extended from the bearing supporting part in a radial direction may be formed in the bearing housing.

The middle rib may be extended from the bearing supporting part in a circumferential direction and the middle rib may be projected forward and recessed backward alternatively.

A tub back coupling part to which the tub back is coupled may be formed in a projected portion of the middle rib in a forward direction of the bearing supporting part.

The tub back coupling part may be formed in a gentle curvature shape having a center projected toward the tub.

The tub back may be coupled to the tub back coupling part by a coupling material configured to pass through a rear recessed portion of the middle rib.

The height of the recessed portion may be larger than the height formed by the coupling material.

A stator coupling part to which the stator is coupled may be formed in a projected portion of the middle rib in a backward direction of the bearing supporting part.

The middle rib may form an installation distance between the tub back and the stator.

The tub may be supported by the suspension unit more rigidly than the drum is supported. The suspension unit may include a supporting bracket extended toward a front part of the suspension unit in parallel to the shaft and a cylinder damper configured to support the supporting bracket. The tub may further include an opening formed in a front part thereof to load laundry therein and a door configured to open and close the opening.

In the meanwhile, according to the laundry machine, the tub may be fixedly installed or supported by a flexible structure such as the suspension unit. Or the supporting of the tub may be in the middle of the suspension supporting and the fixed supporting.

That is, the tub may be supported flexibly by using the suspension unit which will be described in detail in the description of the invention, or it may be supported more rigidly than the flexible supporting. For example, the tub may be supported by the suspension unit or a rubber bushing which can give a predetermined flexible motion to the tub, less flexible than the support by way of the suspension unit. Or the tub may be fixedly installed.

Examples of tubs supported more rigidly than the supporting of the suspension unit will be followed.

First of all, a predetermined portion of the tub may be integrally formed with the cabinet.

Second, the tub may be connected and supported by a screw, rivet, rubber bushing and the like or fixedly welled, adhered or sealed. In this case, the rigidity of the suspension unit is stronger than the rigidity of these connecting materials with respect to a vertical direction which is a main vibration direction of the drum.

Such the tub may be enlarged in a possible limited installation space. That is, the tub may be enlarged to be adjacent to a wall or frame, which limits the horizontal size of the installation space, with respect to at least a right and left direction orthogonal to a shaft direction if the shaft is horizontally installed. Here, the tub may be integrally formed with a right or left wall of the cabinet.

The tub may be closer to the wall or frame than to the drum in the right and left direction. For example, the tub may be 1.5 times or less as distant from the wall or frame by as from the drum. In the state of the tub enlarged in the right and left direction, the drum may be also enlarged in the right and left direction. As the right and left direction distance is getting smaller between the tub and the drum, the drum may be enlarged in the right and left direction as much. The right and left direction vibration of the drum may be put into consideration to reduce the right and left direction distance between the tub and the drum. As the right and left direction vibration of the drum is getting smaller, the diameter of the drum may be enlarged more. As a result, the right and left direction rigidity of the suspension unit configured to suspend the vibration of the drum may be larger than the other direction rigidity. For example, the rigidity of the suspension unit with respect to right and left direction displacement may be the maximum with respect to the other direction rigidity.

Furthermore, the suspension unit may be directly connected with the bearing housing configured to support the shaft connected with the shaft, different from the suspension unit connected via the tub according to the conventional laundry machine. That is, the bearing housing may include a supporting part configured to support the shaft and an extending part extended from the supporting part. The suspension unit may be coupled to the supporting part or the extending part of the bearing housing.

At this time, the suspension unit may include a bracket extended with respect to the shaft direction and the bracket may be extended forward to the door.

The suspension unit may include at least two suspensions distant from each other in the shaft direction.

The suspension unit may include a plurality of suspensions installed below the shaft to standing-support a supporting object, for example, the drum. The suspension unit may include a plurality of suspensions installed beyond the shaft to hang the supporting object thereto. According to these cases, suspensions are provided only below or beyond the shaft.

The gravity center of the vibration system including the drum, shaft, bearing housing and motor may be located in at least predetermined portion adjacent to the motor with respect to a longitudinal shape of the drum.

At least one suspension may be in front or rear of the gravity center or suspensions may be installed in front and rear of the gravity center, respectively.

The tub may include an opening formed in a rear part thereof. A driving part including the shaft, bearing housing and motor may be connected with the tub via a flexible material. The flexible material seals the opening formed in the rear part of the tub to prevent wash water from flowing out of the tub via the opening and to enable the driving part to relative-move with respect to the tub. Such the flexible material may be any flexible material which can seal, for example, gasket material such as front gasket. In this case, the flexible material may be named as rear gasket corresponding to the front gasket. The connection of the rear gasket with the driving part may be implemented in a rotational constrained state with respect to the rotational direction of the shaft. According to an embodiment, the rear gasket may be directly connected with the shaft or it may be connected with the extending part of the bearing housing.

A predetermined portion of the driving part which is located in a front connection with the rear gasket only to be exposed to wash water may be made of anticorrosive material. For example, the portion may be coated or covered with an auxiliary plastic-made part, for example, a tub back which will be described in detail. If there is a metal-made portion of the driving part, the metal-made portion may not be exposed to water directly and corrosion may be prevented accordingly.

Here, the cabinet may not be provided, different from the embodiment of the present invention. For example, a built-in laundry machine may be provided in a wall, instead of the cabinet. That is, the laundry machine may be fabricated without the cabinet configured to define the exterior appearance of the laundry machine. Even in this case, the front part of the cabinet may be formed.

Advantageous Effects of Invention

The present invention has following an advantageous effect.

According to the laundry machine of the present invention, a drum type laundry machine having a totally different new structure is provided. As a result, the vibration of the drum is not transmitted to the tub and it may be suspendingly supported.

Furthermore, according to the laundry machine of the present invention, the structure is changed to increase a washing capacity and the load of the tub having the increased capacity is supported vertically. As a result, stability of the tub supporting structure may be improved advantageously.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
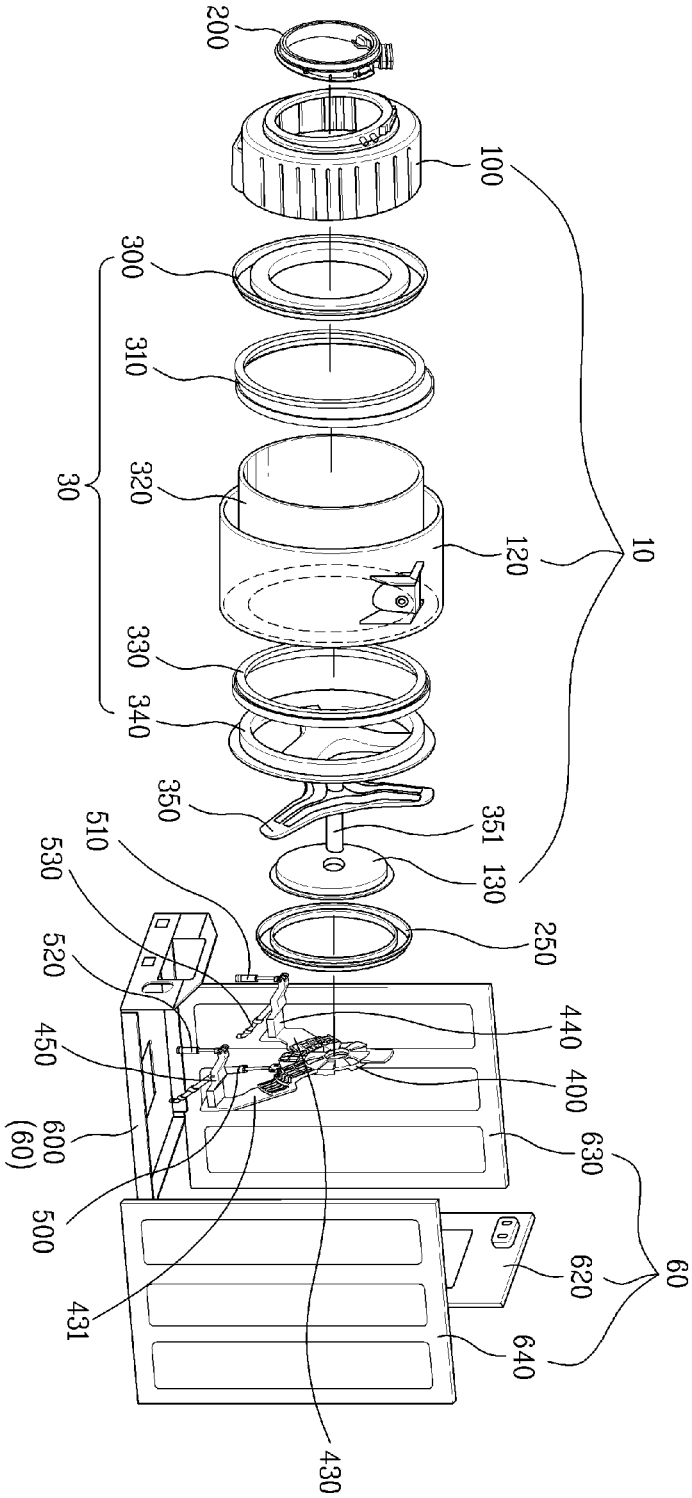
FIG. 1 an exploded perspective view illustrating a laundry machine according to an exemplary embodiment of the present invention.

FIG. 1 is an exploded perspective view illustrating a laundry machine according to an exemplary embodiment of the present invention.

As shown in FIG. 1, the laundry machine includes a tub fixedly installed in a cabinet 60. The tub 10 includes a tub front 100 configured to define a front of the tub 10 and a tub rear 120 configured to define a rear of the tub 10. The tub front 100 and the tub rear 120 are assembled by screws and a predetermined space is formed in the assembled tub front and tub rear 120 to accommodate a drum 30. The tub 10 may further include a tub back configured to form a rear surface of the tub 10 and the tub back is connected with the tub rear 120 via a rear gasket 250. The rear gasket 250 may be made of flexible material not to transmit the vibration of the tub back 130 to the tub rear 120.

The cabinet defines an exterior appearance of the laundry machine and it includes a cabinet front (not shown), a cabinet rear 620, a cabinet left 640, a cabinet right 630, a cabinet top (not shown) and a cabinet base 600.

The tub rear 120 has a rear surface 128 and the rear surface 128 of the tub rear 120, the tub back 130 and the rear gasket 250 forms a rear surface of the tub 10. The rear gasket 250 is sealed and connected with both of the tub back 130 and the tub rear 120, such that wash water inside the tub 10 may not leak. The tub back 130 is rotated together with the drum 30 when the drum 30 is rotated. At this time, the tub back 130 is distant from the tub rear 120 a predetermined distance not to interfere with the tub rear 120. Since the rear gasket 250 is made of flexible material, the tub back 130 is relative-moved, not interfering with the tub rear 120. The rear gasket 250 may include a corrugated part (252, see FIG. 4) extendible enough to enable this relative-motion.

A foreign substance preventing material 200 is provided in a front part of the tub front 100 to prevent foreign substances from coming between the tub 10 and the drum 30. The foreign substance preventing material 200 is flexible material and it is fixedly installed to the tub front 100. Here, the foreign substance preventing material 200 may be made of a predetermined material identical to the material of rear gasket 250.

The drum 30 is configured of a drum front 300, a drum center 320 and a drum back 340. Ball balancers may be installed in front and rear parts of the drum 30, respectively. The drum back 340 is connected with a spider 350 and the spider 350 is connected with a shaft 351. The drum 30 is rotated in the tub 10 by a rotational force transmitted via the shaft 351.

The shaft 351 is directly connected with a motor, passing through the tub back 130. Specifically, a rotor (not shown) of the motor is directly connected with the shaft 351. A bearing housing 400 is coupled to the rear surface 128 of the tub back 130 and the bearing housing 400 rotatably supports the shaft 351, located between the motor and the tub back 130.

A stator is fixedly installed in the bearing housing 400 and the rotor is located around the stator. As mentioned above, the rotor is directly connected with the shaft 351. Here, the motor may be an outer rotor type motor connected with the shaft 351 directly.

A suspension unit (40, see FIG. 5) located from the cabinet base 600 to support the bearing housing 400. The suspension unit 40 includes three spring cylinder dampers 500, 5100, and 520 and two cylinder dampers 530 and 540 configured to obliquely support the bearing housing 400 in a forward and backward direction. The suspension unit 40 is connected to the cabinet base 600 flexibly to allow the drum 30 to move in forward/backward and rightward/leftward directions, not completely fixed to the cabinet base 600.

That is, the suspension unit 40 is flexible enough to allow the predetermined forward/backward and rightward/leftward rotation of the drum 30 with respect to the supporting point of the suspension unit connected with the cabinet base 600. Perpendicular suspensions may be installed in the cabinet base 600 in the media of a rubber bushing (not shown). Perpendicular ones of the suspensions are used to suspend the vibration of the drum 30 elastically and oblique ones of them are used to dampen the vibration of the drum 30. That is, the perpendicular one is employed as spring out of a vibration system including a spring and damping means and the oblique ones as damping means.

The other parts of the tub 10 may be fixedly installed to the cabinet, except the tub back 130 and the vibration of the drum 30 is suspended and supported by the suspension unit. Substantially, each of the tub 10 and the drum 30 has a separate supporting structure. Even if the drum 30 is vibrated, the tub 10 may not be vibrated.

As follows, each element will be described in detail.

Figure 2:
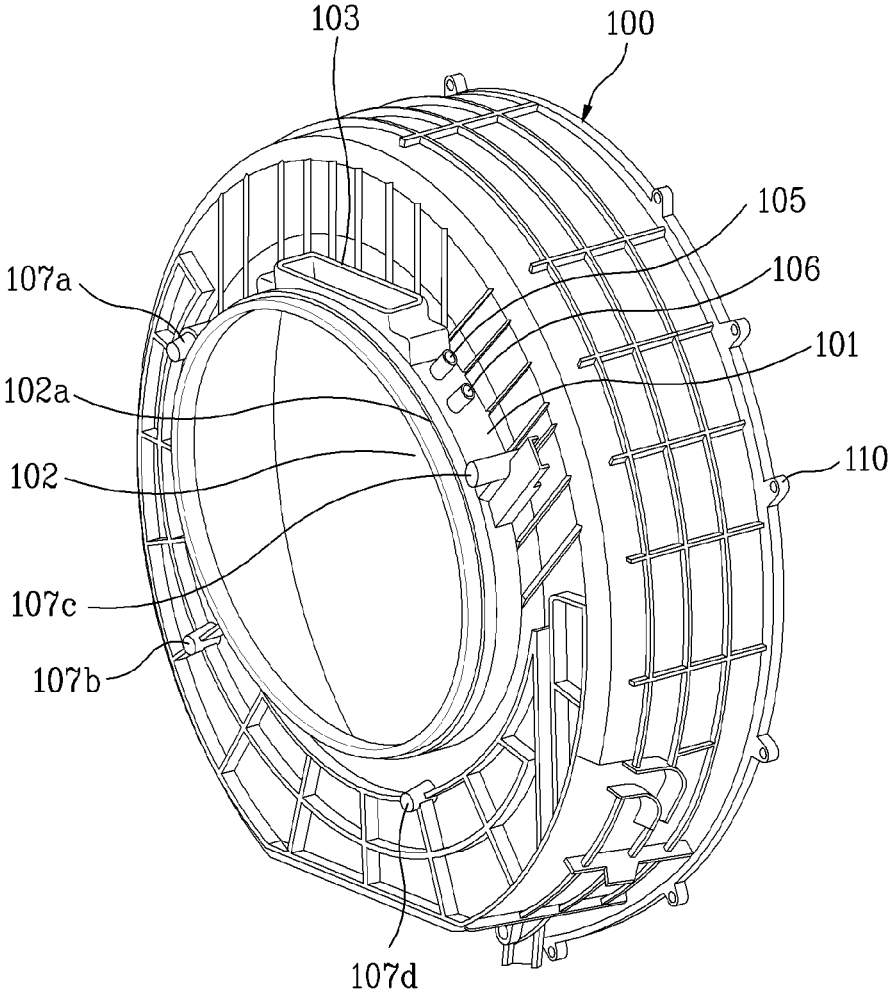
FIGS. 2 and 3 are perspective view illustrating a tub front of the laundry machine.
Figure 3:
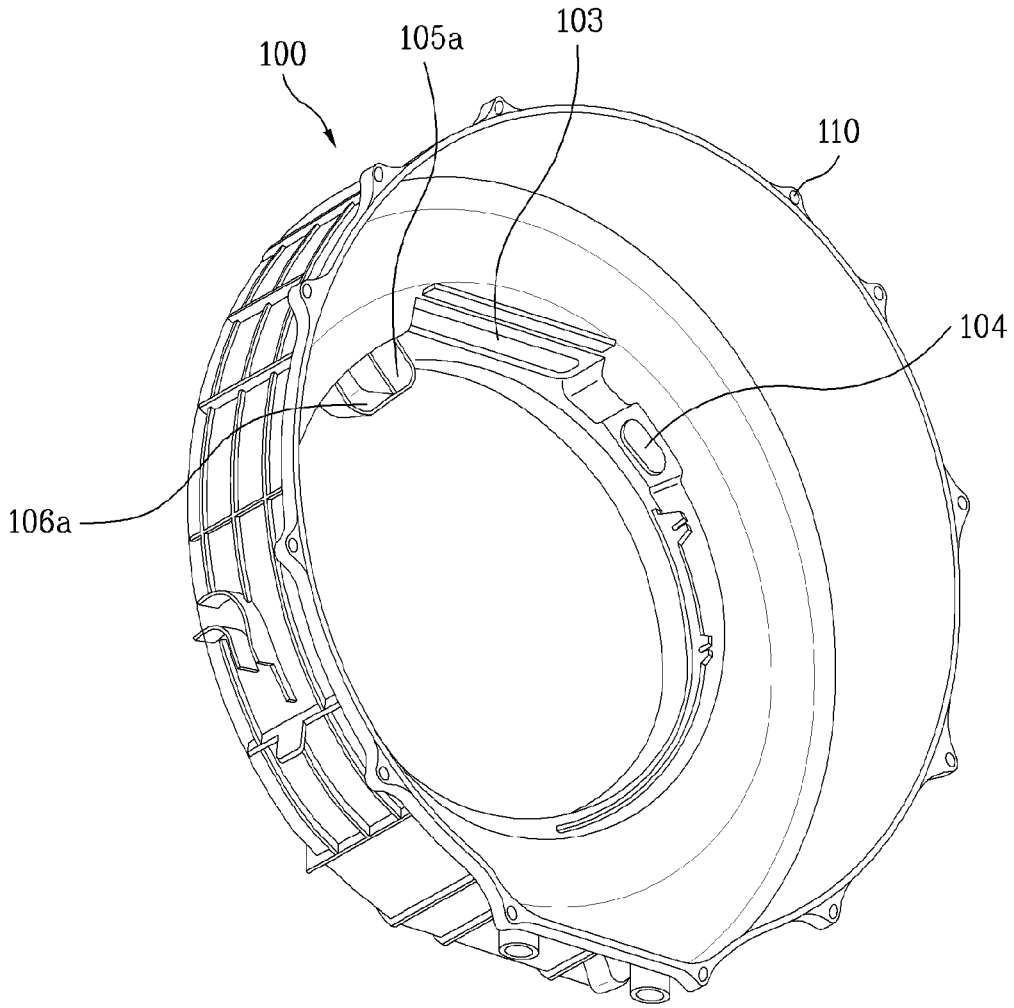

FIGS. 2 and 3 are diagrams illustrating the tub front 100. The tub front 100 includes a donut-shaped perpendicular front surface provided in a front portion of a cylindrical surface composing a predetermined portion of a side wall of the tub. A rear portion of the cylindrical surface is open as it is and the rear portion includes a plurality of securing holes 110 formed therein. The securing holes 110 are secured to corresponding securing holes (127, see FIG. 4) of the tub rear 120.

A rim part 101 is extended forward from an inner circumferential surface of the front surface of the tub front 100. The width of the rim part 101 is getting narrower downward from the top and substantially the rim part 101 may not be formed at a lower portion of an inner corner of the front surface.

In the rim part 101 may be formed a water supply inlet 104 configured to supply wash water, a hot air inlet 103 which will be used in a drying course, a circulating-water inlet 106 configured to drawn the wash water circulated by a circulation pump there through and a steam inlet 105 configured to draw steam there through.

Since the vibration of the tub 10 is noticeably reduced in the laundry machine according to the present invention, a water supply structure of a water supply hose, a drying structure of a drying duct and a steam supply structure, a circulating-water supply structure and the like may be implemented stably.

The hot air inlet 103 may be extended from the rim part 101 approximately in a square shape. Here, the hot air inlet 103 is required by a laundry machine having washing and drying functions and not by a laundry machine having no drying function.

The water supply inlet 104, the hot air inlet 103 and the like are formed in the front part of the tub front 100. Because of that, the supply of wash water, hot air and the like may be implemented in the front part of the tub 10.

The water supply inlet 104 and the other components may be located more forwardly than a front end of the drum 30 accommodated in the tub 10. As a result, the wash water, hot air and the like may be directly drawn into the drum 30 via the opening of the drum 30 configured to load the laundry therein or there out. Since fluidal material supplied to treat the laundry such as the wash water and hot air may be directly drawn into the drum 30 and this enables the laundry to be treated more efficiently.

In case detergent is supplied via a detergent box, together with the wash water, the detergent is directly drawn into the drum 30 and the amount of used detergent may be reduced accordingly, such that the amount of wash water may be reduced.

Here, a problem of tub contamination generated by detergent remnant loaded in a bottom of the tub may be solved. In case water is supplied from the front part of the tub, a door glass (not shown) may be washed by the supplied water advantageously.

Even if hot air is supplied via the front portion of the tub, a perpendicular surface of the tub front 100, that is, a front surface thereof, the hot air flow may be '⊂'-shaped, which is a complex air path formed by the hot air re-bent toward a perpendicular front surface of the tub after hot air having flown from the rear portion of the tub is bent downward from a front portion of a upper part of the tub. This '⊂'-shaped air path will not be helpful to efficient hot air flow. However, when the hot air inlet 103 is formed in the rim part 101 of the tub front 100, the hot air may be bent perpendicularly one time and it may flow smoothly.

The water supply inlet 104 and the other holes may be located beyond a center of the drum. Because of that, the wash water and the like may be supplied to the drum inside from a front upper portion of the drum. If it is necessary to supply the wash water and the like to the drum inside from a front lower portion of the drum, the rim part 101 of the tub front 100 may be formed in a lower portion of the front surface part 112. if it is necessary to supply the wash water and the like in a right and left direction, not in the upward and downward direction mentioned above, the rim part 101 may be formed in a inner corner center portion 131 of the front surface part 112. That is, the appearance of the rim part 101 may be variable according to which direction the supplied fluidal material is supplied along.

A coupling part 102 is formed in the rim part 101 to couple the foreign substance preventing material 200 to the tub front 100. The coupling part 102 is extended forward from the front end of the rim part 101, having a small cylindrical surface-like shape. Ribs 102*a* are formed in an outer circumferential surface of the small cylindrical surface.

Once the coupling part 102 is inserted in the foreign substance preventing part 200, the foreign substance preventing part 200 may be coupled to the coupling part 102. for that, inserting recesses (not shown) are formed in the foreign substance preventing material 200 and the small cylindrical surface having the ribs 102*a* formed therein is inserted in the inserting recess (not shown).

The tub front 100 is fixedly coupled to the cabinet front (not shown) and coupling bosses 107*a*, 107*b*, 107*c* and 107*d* are formed in the front surface of the tub front 100 for such the fixed coupling, approximately surrounding the rim part 101. After the cabinet front (not shown) is located in a state of the tub front 100 installed, screws are fastened backward to couple the tub front 100 to the cabinet front.

FIG. 3 is a rear view illustrating an inside of the tub front 100. The steam inlet 105 may be connected with a seam hose. A steam guide 105*a* is formed in the tub front 100 to guide steam drawn via the steam inlet 105 toward a drum inside and a circulating-water guide 106*a* is formed in the tub front 100 to guide circulating-water drawn via the circulating-water inlet 106 toward the drum inside. The steam inlet 105, the circulating-water inlet 106, the steam guide 105*a*, the circulating-water guide 106 and the like may be integrally formed with the tub front 100. The tub front 100 is plastic-injection-molded and the steam inlet 105 and the other components may be injection-molded as some parts of the tub front 100.

The tub front 100 is coupled to the tub rear 120 to form a predetermined space configured to accommodate the drum 30. Here, the tub front 100 and the tub rear 120 may be screw-fastened to each other. For this screw-fastening, a plurality of screw-securing holes 110 may be formed along a circumference of the rear part of the tub front 100.

Figure 4:
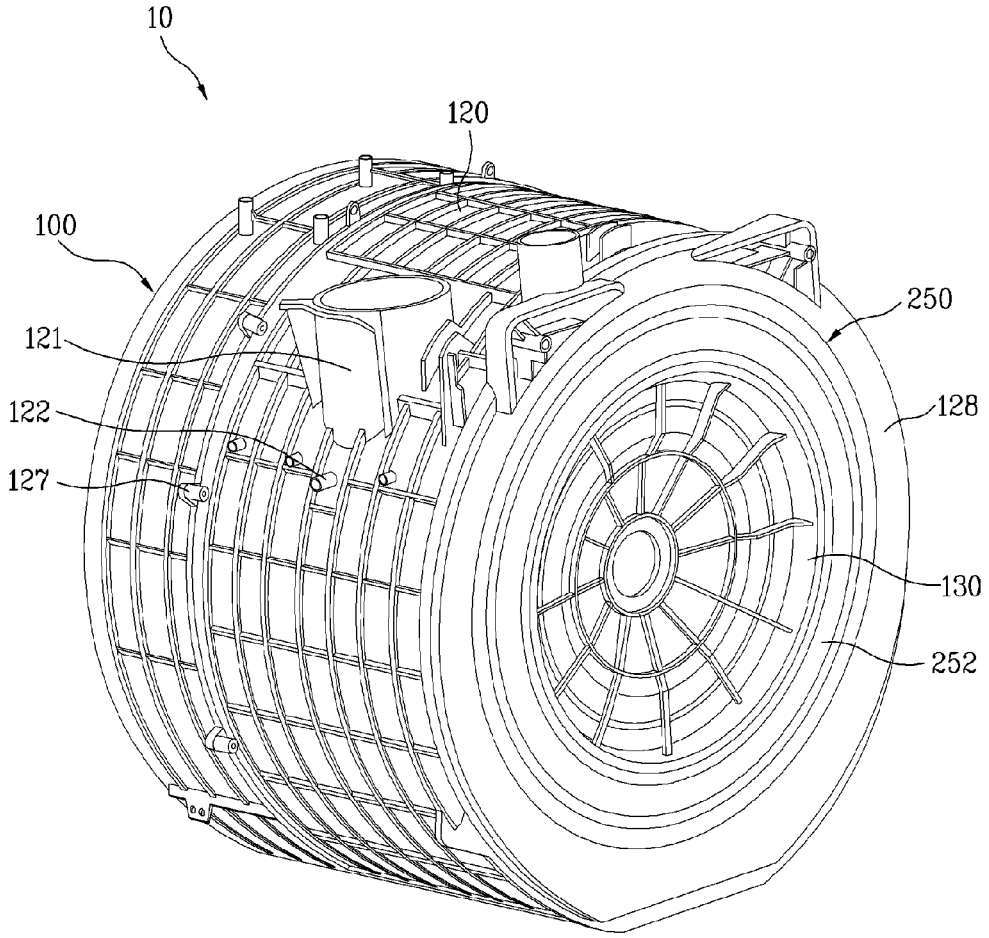
FIG. 4 is a rear perspective view illustrating a tub rear of the laundry machine.

FIG. 4 is a diagram illustrating the connection among the tub front 100, the tub rear 120, the tub back 130 and the rear gasket 250.

The tub rear 120 is cylindrical-shaped to surround the drum 30 and a front part of the tub rear is open and a rear part of the tub rear includes a donut-shaped rear surface 128. The front part is sealing-coupled to the tub front 100. A diameter of the rear surface 128 of the tub rear 120 is larger than an outer diameter of the tub back 130. Even when the tub back 130 is vibrated, the tub back 130 is distant from the tub rear 120 enough not to interfere with the rear surface 128 of the tub rear 120.

The rear gasket 250 is provided between the rear surface 128 of the tub rear 120 and the tub back 130. The rear gasket 250 seals the rear surface 128 of the tub rear 120 and the tub back 130 and it includes a corrugated part 252 flexible enough not to interfere with the vibration of the tub back 130.

A hot air inlet 121 is formed in a predetermined portion of the tub rear 120 in case of the laundry machine having washing and drying functions. In case of the laundry machine only having the washing function, the hot air outlet 121 may be not provided, of course.

An auxiliary structure configured to fixedly support the tub with respect to the base is formed in lower parts of the tub rear 120 and the tub front 100.

Figure 5:
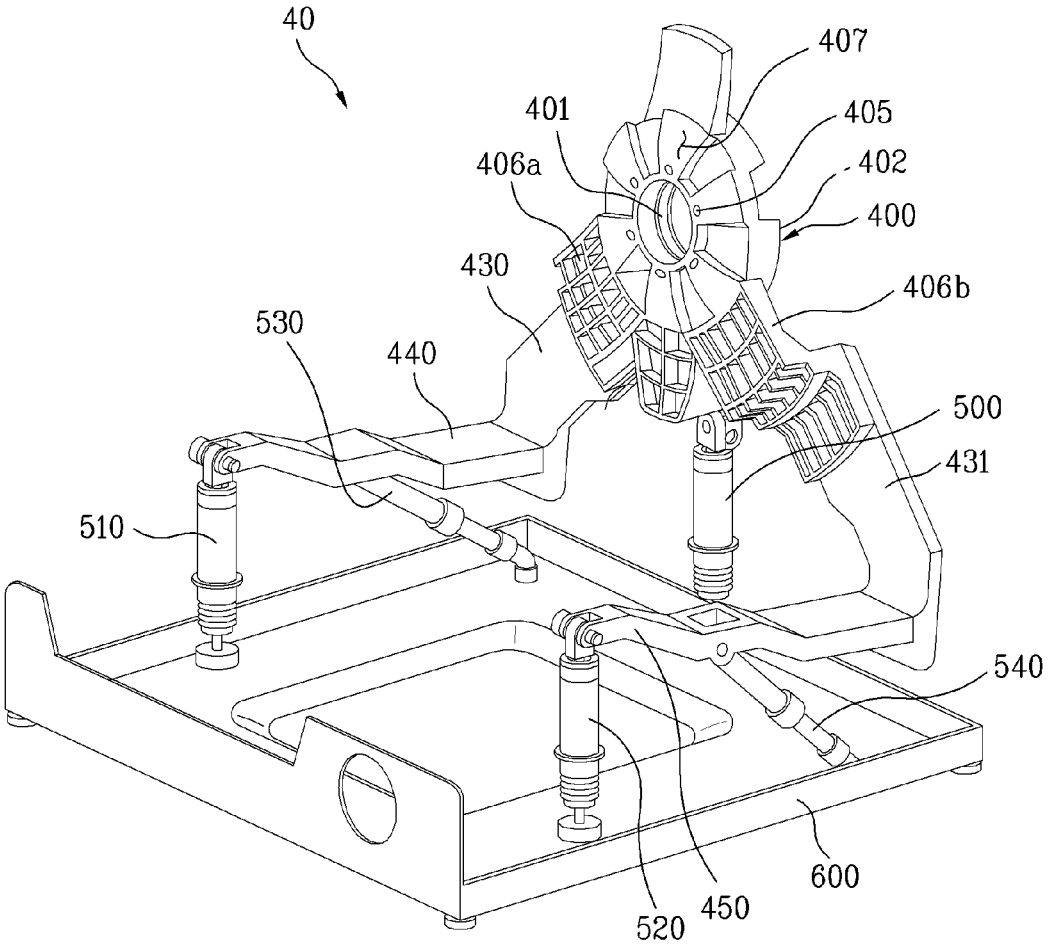
FIG. 5 is a perspective illustrating a suspension of the laundry machine.
Figure 6:
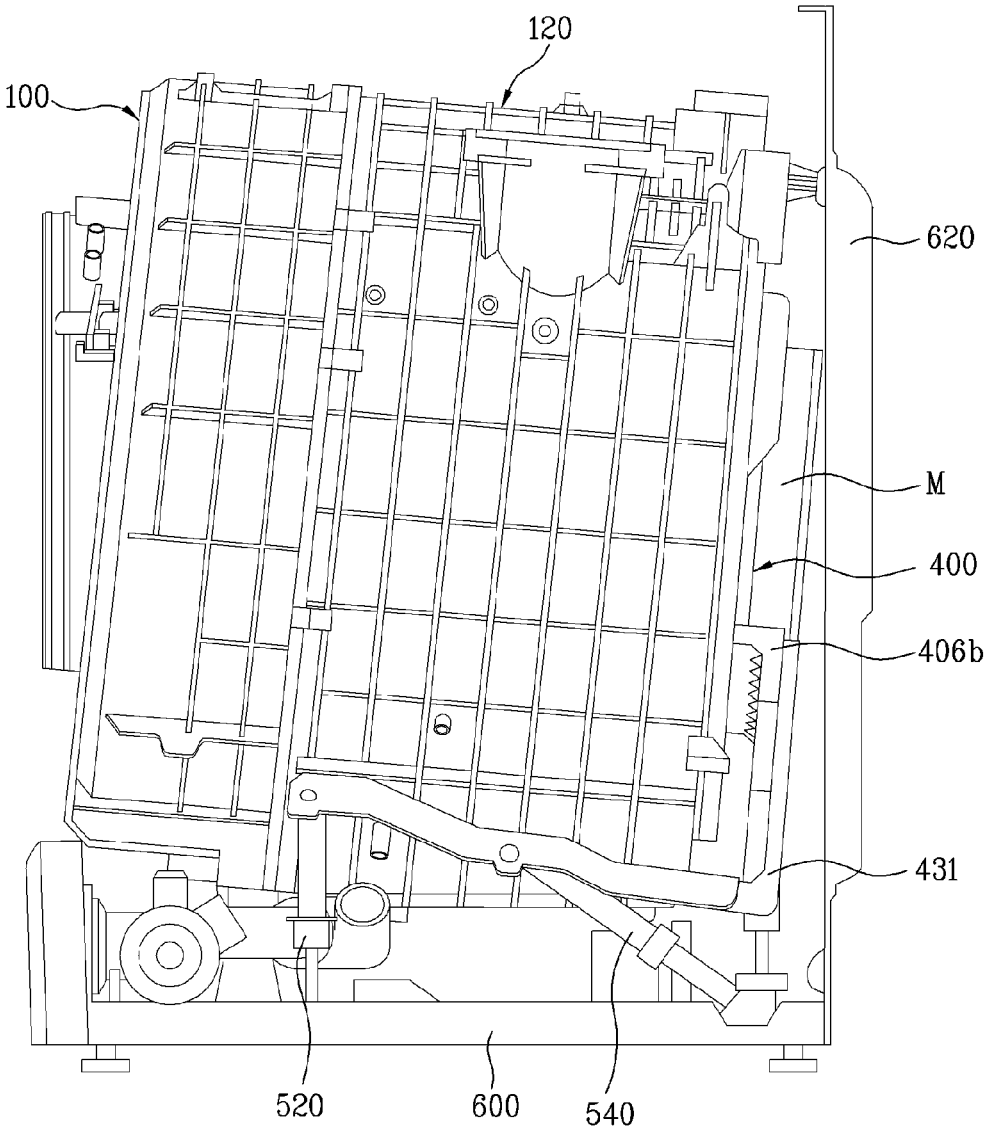
FIG. 6 is a side view illustrating a coupling state between the tub and the suspension provided in the laundry machine.

FIG. 5 is a diagram illustrating the suspension unit 40 mounted on the base 600. FIG. 6 illustrates a coupling state among the tub 100 and 120, the bearing housing 400 and the suspension unit 40.

The bearing housing 400 include a bearing supporting part 401 configured to support a bearing. A tub back securing part 407 configured to secure the tub back 250 thereto is formed in a front portion of the bearing housing 400 and a stator securing part 402 configured to secure the stator of the motor thereto is formed in a rear portion of the bearing housing 400.

Here, the suspension unit 40 includes a first oblique bracket 431, a second oblique bracket 430, a first suspension bracket 450 and a second suspension bracket 440.

A first extending part 406*a* and a second extending part 406*b* extended from right and left side portions of the bearing housing 400 in a radius direction, respectively. The first oblique bracket 431 and the second oblique bracket 430 are connected to the first extending part 406*a* and the second extending part 406*b*, respectively. The first suspension bracket 450 and the second suspension bracket 440 are connected to the first oblique bracket 431 and the second oblique bracket 430, respectively.

Here, the shapes of the first extending part 406*a*, the first oblique bracket 431, and the first suspension bracket 450, the second extending part 406*b*, the second oblique bracket 430 and the second suspension bracket 440 are corresponding to each other. When the laundry is loaded in the drum, the first and second oblique brackets 431 and 430 are used to balance the center of gravity and they are used as mass in the vibration system of the drum.

The suspension unit 40 includes a first spring cylinder damper 520, a second spring cylinder damper 510 and a third spring cylinder damper 500 which are arranged vertically for the vertical suspension and a first cylinder damper 540 and a second cylinder damper 530 which are arranged obliquely for the backward suspension.

Here, a single one of the first spring cylinder damper 520, the second spring cylinder damper 510 and the third spring cylinder damper 500 may be arranged in a rear portion and the other two may be arranged in front right and left portions with respect to a center of the base 600. The first cylinder damper 540 and the second cylinder damper 530 may be arranged oblique forward and backward from rear right and left sides with respect to the center of the base 600, respectively.

Specifically, the first spring cylinder damper 520 is connected between the first suspension bracket 450 and the base 600. The second spring cylinder damper 510 is connected between the second suspension bracket 440 and the base 600. The third spring cylinder damper 500 is directly connected between the bearing housing 400 and the base 600.

The first cylinder damper 540 is obliquely installed between the first suspension bracket 450 and a rear portion of the base and the second cylinder damper 530 is obliquely installed between the second suspension bracket 440 and a rear portion of the base 600.

That is, the third spring cylinder damper 500 is arranged in a center of the rear portion and the first spring cylinder damper 520 and the second spring cylinder damper 510 are arranged in right and left sides of the rear portion. The first cylinder damper 540 and the second cylinder damper 530 are located on right and left sides of the third spring cylinder damper 500. That is, the spring cylinder dampers 500, 510 and 520 and the cylinder dampers 530 and 540 are vertically symmetrical.

As follows, the structure of the tub back 130 will be described in reference to FIGS. 7 and 8.

Figure 7:
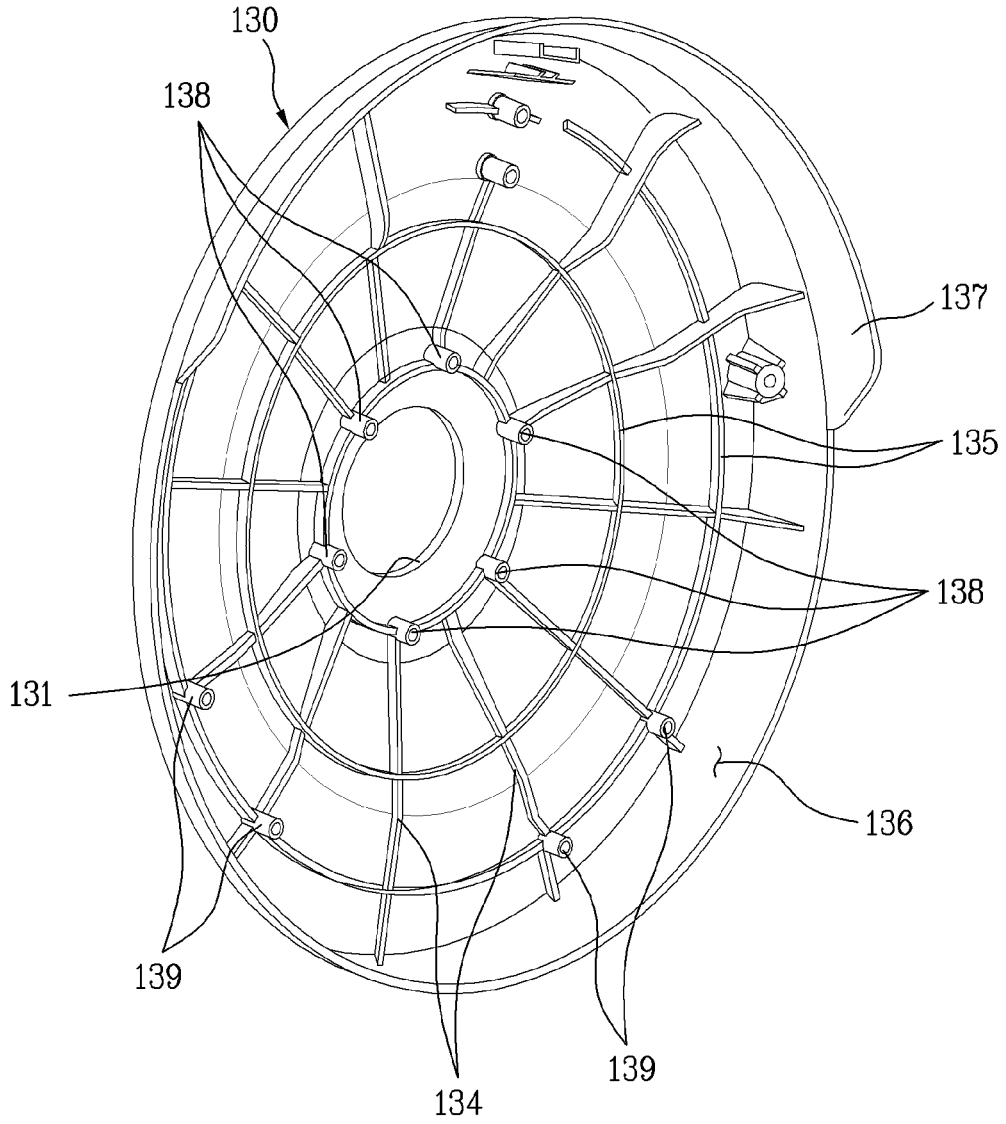
FIG. 7 is a rear perspective view illustrating a tub back of the laundry machine according to the present invention.
Figure 8:
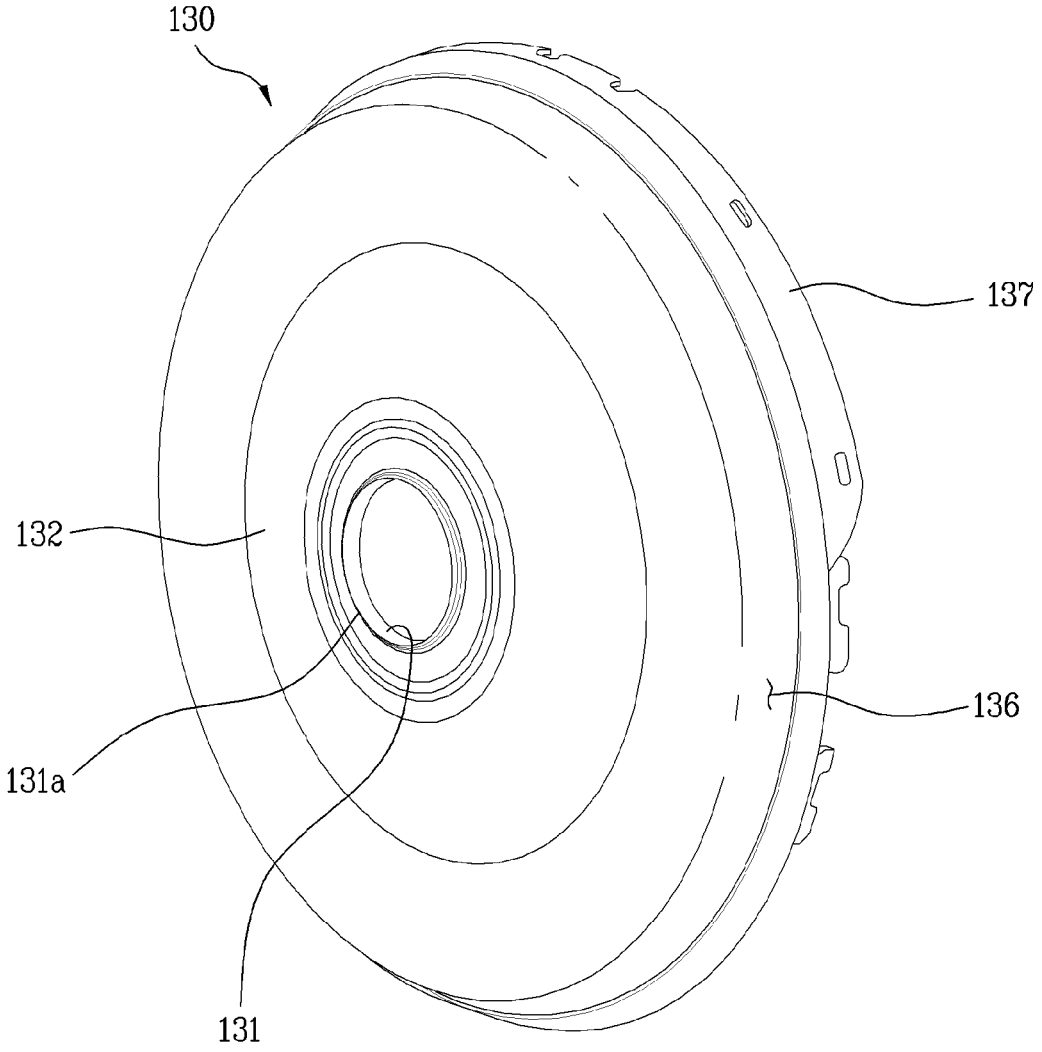
FIG. 8 is a front perspective view illustrating the tub back of the laundry machine according to the present invention.

FIG. 7 is a rear-respective view illustrating the tub back 130 of the laundry machine according to the present invention and FIG. 8 is a front perspective view illustrating the tub back 130 of the present invention according to the present invention.

As shown in FIGS. 7 and 8, the tub back 130 according to the present invention is coupled to the rear part of the tub rear 120 by the rear gasket 250. For that, the rear gasket 250 is formed in a small disc which is smaller than a hollow formed in the tub rear 120.

A through hole 131 is formed in a center portion of the tub back 130 to pass the shaft 351 connected to the drum 30 there through. A gentle curvature surface 132 is formed in the front surface of the tub back 130, that is toward the inside of the tub 10, with a convex outer circumference of the through-hole 131. A plurality of ribs 134 and 135 and bosses 138 and 139 may be formed in the rear surface of the tub back 130 to reinforce the rigidity of the tub back 130 and the coupling with the bearing housing 400.

As shown in FIG. 7, the through-hole 131 is formed in the rear surface of the tub back 130 through the center of the tub back 130 and the shaft 351 configured to rotate the drum 30 passes through the through-hole 131.

The plurality of the ribs 134 and 135 may be formed along an outer circumferential surface of the through-hole 131 to reinforce the rigidity of the tub back 130. the ribs 134 and 135 includes radial ribs 134 extended from the through-hole 131 in a radial shape and circular ribs 135 loaded from the through-hole 131 in a circular shape. The number of the radial ribs 134 and the circular ribs 135 may be increased or decreased to reinforce the rigidity of the tub back 130.

A rim part 136 having a predetermined height is formed in an outer circumferential surface of the tub back 130. A coupling part (not shown) is formed in an outer circumferential surface of the rim part 136 to couple the tub back 130 to the rear gasket 250 and a water wall 137 is formed in an upper portion of the rim part 136 of the tub back 130 to prevent water having leaked through the outer circumference of the tub back from flowing into the motor located in the center of the tub back.

In the meanwhile, A plurality of coupling bosses 138 may be formed in the radial ribs 134 and the circular ribs 135 to couple the bearing hosing 400 to the tub back 130. The coupling bosses may be formed in intersection points of the radial ribs 134 and the circular ribs 135.

A plurality of auxiliary bosses may be further formed in the outer portion of the tub back 130 for auxiliary coupling with the bearing housing 400. The auxiliary bosses 139 may be vertically symmetrical with respect to the through-hole 131. It is preferable that the auxiliary bosses 139 may be formed at intersection points of the radial ribs 134 and the circular ribs 135, respectively. These coupling bosses 138 and the auxiliary bosses 139 couple the bearing house to the tub back 130 in outward and inward directions, only to prevent deformity of the tub back 130.

As shown in FIG. 8, the through-hole 131 is formed in the center of the front surface of the tub back 130, passing through the tub back 130, and the shaft 351 configured to rotate the drum 30 passes through the through-hole 131. A circular inserting rim part 131*a* is projected forward along the inner circumferential surface of through-hole 131 and the spider 350 includes a recessed portion in which the inserting rim part 131*a* is inserted. A circumferential rear surface surrounding the through-hole 131 is seated on a front surface of a bearing supporting part 401 of the bearing housing 400. A portion of a waterseal is placed between the circumferential rear surface surrounding the through-hole 131 and the front surface of a bearing supporting part 401 to prevent water from leaking between the tub back and the bearing housing.

In the meanwhile, the gentle curvature surface 132 projected toward the drum is formed in an outer circumference of the through-hole formed in the front surface of the tub back 130.

The gentle curvature surface 132 prevents the drum from contacting with the tub back 130 according to a rotational radius and a vibration radius of the drum 30 when the drum 30 connected with the shaft 351 is vibrated. That is, when there is vibration of the drum 30, the drum 30 is vibrated with respect to the shaft 351 and a rear outer circumferential surface of the drum happens to contact with a rear outer circumferential surface of tub 10 accordingly. Because of that, the distance between an external rear outer circumferential surface of the tub 10 and the drum 30 has to be wider than the distance between a rear center of the tub 10 and the drum 30.

In addition, the gentle curvature surface 132 is provided to prevent the contact between the tub back and the drum and simultaneously to secure the coupling space of the bearing housing 400 coupled to the outer surface of the tub back 130. that is, the center of the tub back 130, which is a portion of the tub back the bearing housing 400 is coupled to, is recessed toward the inside of the tub 10 and the rear space of the tub back 130 is increased. This gentle curvature surface 132 may enable the rear portion of the tub slim and compact. That is, the rear portion of the tub back 130 is internally recessed as much as the center front surface of the tub back 130 is recessed toward the tub inside by the gentle curvature surface 132.

As follows, the structure of the bearing housing 400 provided in the laundry machine according to the present invention will be described in reference to FIGS. 9 and 10.

Figure 9:
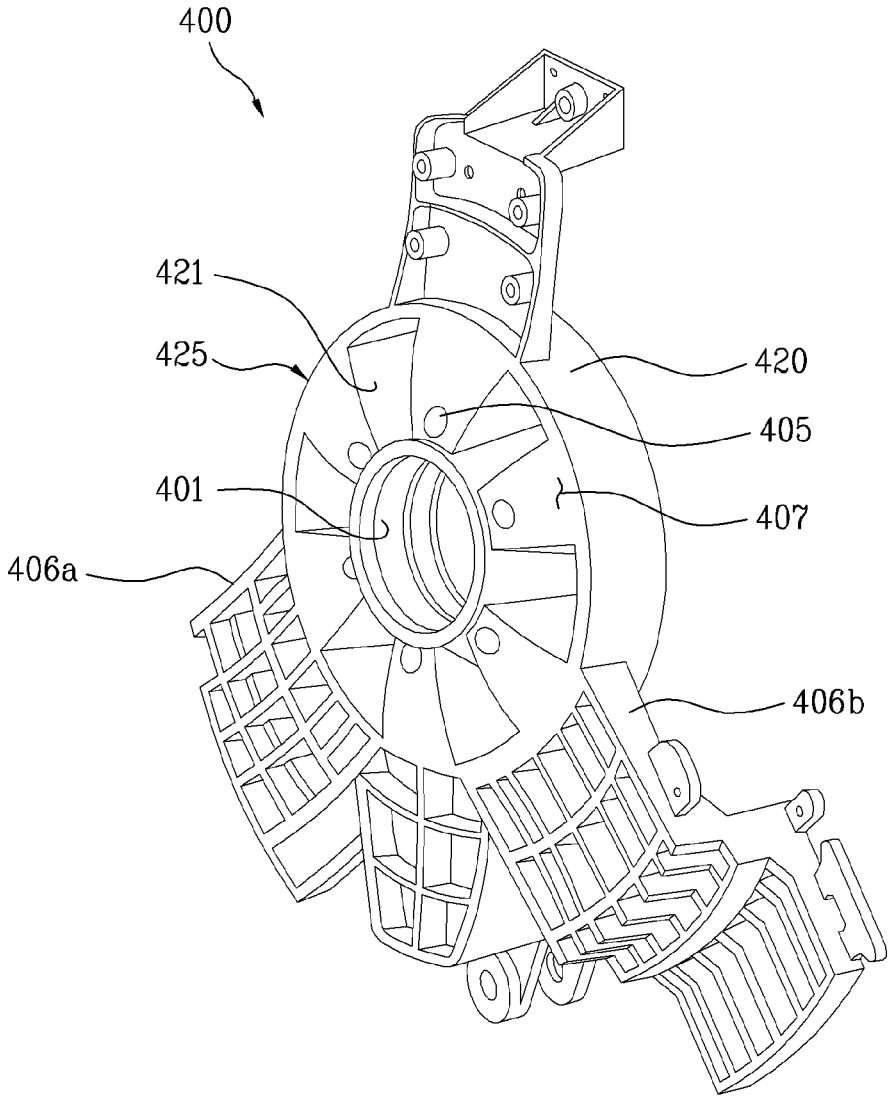
FIG. 9 is a front perspective view illustrating a bearing housing of the laundry machine according to the present invention.
Figure 10:
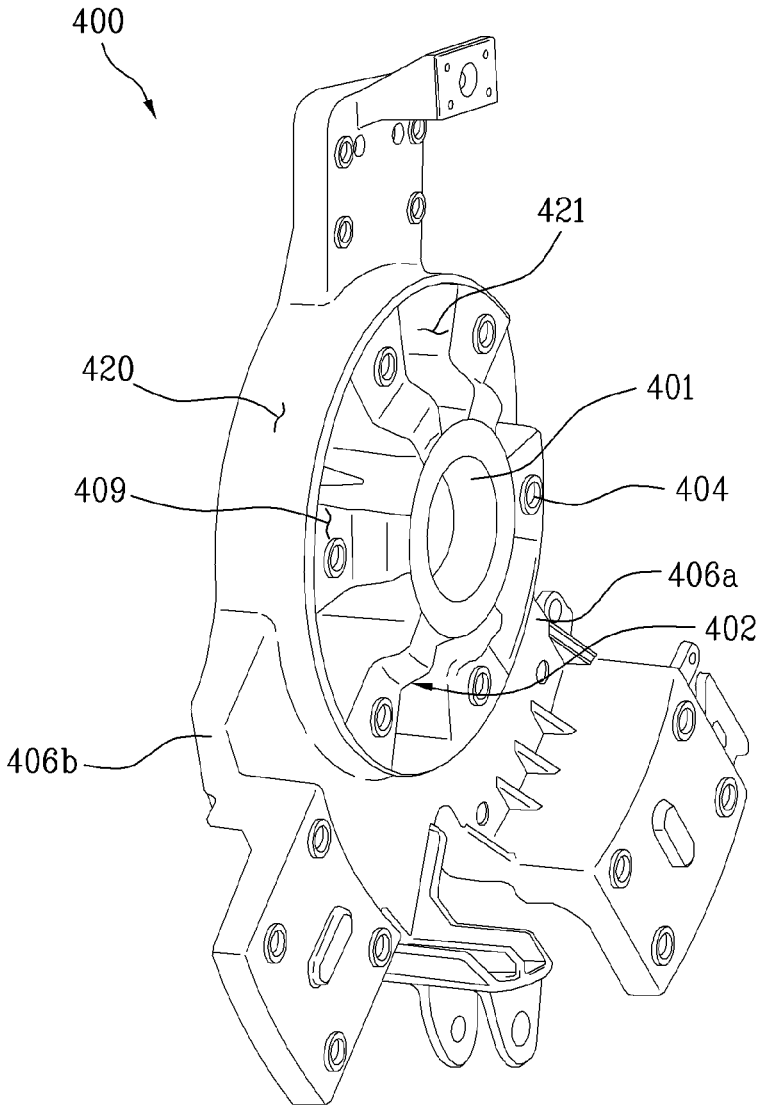
FIG. 10 is a rear perspective view illustrating the bearing housing of the laundry machine according to the present invention.

FIG. 9 is a front perspective view illustrating the bearing housing of the laundry machine according to the present invention and FIG. 10 is a rear perspective view illustrating the bearing housing of the laundry machine according to the present invention.

Figure 12:
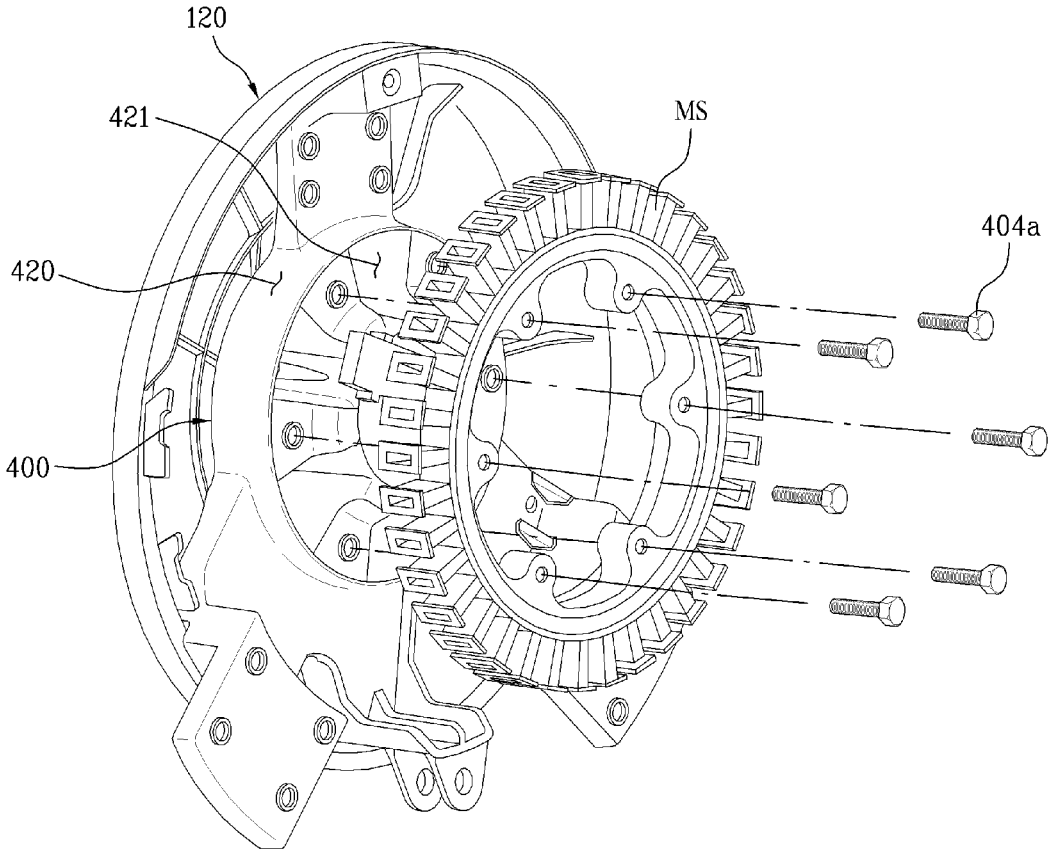
FIG. 12 is a perspective view illustrating a coupling state between the tub back and a stator.

As shown in FIG. 9, the bearing housing 400 includes a bearing supporting part 401 configured to support a bearing, a tub back coupling part (425, see FIG. 8) configured to couple the tub back 130 to the bearing housing and a stator coupling part 402 configured to couple a stator (MS, see FIG. 12) to the bearing housing 400.

Here, the tub back coupling part 425 and the stator coupling part 402 are extended from the bearing supporting part 401 in a radial direction, integrally formed with bearing supporting part 401.

The tub back coupling part 425 and the stator coupling part 402 may be formed by zigzagged middle ribs 421 extended from the bearing supporting part 401 in a radial direction. This middle ribs 421 are alternatively projected and recessed like corrugation along a circumferential direction. Predetermined ones of the middle ribs 421 toward the front surface may form the tub coupling part 425 and the other ones toward the rear surface may form the stator coupling part 402.

A ring-shaped outer circumferential rib 420 is formed in an outer circumferential surface of the middle rib 421 of the tub back coupling part 425 and the stator coupling part 402. Here, the outer rib 420 forms an exterior appearance of the bearing housing 400 and it may be thicker than the middle rib 421. This is because the first and second extending parts 406*a* and 406*b* are extended from both sides of the bearing housing 400 in the radial direction. That is, the outer rib 420 is provided to secure enough rigidity, because the extending parts 406*a* and 406*b* are integrally formed with each other. The forward and backward width of the outer rib 420 may be larger than the thickness of the extending parts 406*a* and 406*b*.

Also, the projected portion of the tub back coupling part 425 is corresponding to the recessed portion of the stator coupling part 40 and the projected portion of the stator coupling part 402 is corresponding to the recessed portion of the tub back coupling part 425. This structure may reduce the amount of material composing the bearing housing 400 and secure enough rigidity.

The tub back 130 is seated in tub back coupling part 425 which is a front surface portion of the bearing housing 400 and a stator (MS) is coupled to the stator coupling part 402 which is a rear surface portion of the bearing housing.

In an aspect of the coupling, the tub back coupling part 425 and the stator coupling part 402 should have the minimum thickness required to couple the bearing housing to the tub back 130 and the stator (MS). If there is no other limitations, for example, no rigid problems, a forward/backward width of the middle rib from the position of the boss configured to couple the stator (MS) or the tub back 130 may be identical to the length of the boss.

The laundry machine according to the present invention may not have the fixedly connected or coupled structure between the bearing housing 400 and the tub. As a result, relatively small load is applied to the stator coupling part 402.

Different from the conventional laundry machine, the forward/backward width of the stator coupling part 402, especially, where the boss is located for the coupling of the stator, may be determined by the length of the boss. As the forward and backward width of the stator coupling part 402 is getting smaller, the slim and compact structure of the laundry machine may be getting easier to achieve.

In reference to FIG. 9, the tub back coupling part 425 will be described. A front gentle curvature part 407 having a gentle curvature surface extended from the bearing housing 400 in a radial direction is formed in the projected portions of the front surface of the bearing housing 400, that is, the surface of the bearing housing which is a tub-toward surface of the middle rib 421 extended from the bearing supporting part 401 The tub back coupling part 425.

A coupling hole 405 is formed in the front curvature part 407 to couple the bearing housing 400 to the tub back 130. As they are getting farther from the center with respect to the radial direction, the radially extended portions from the front curvature part 407 out of the projected portions of the front surface of the bearing housing 400 may be getting more oblique backward.

The coupling holes 405 may be formed in centers of the predetermined recesses, respectively. This is for the coupling after protrusions (not shown) formed in the tub back 130 are inserted in the recesses to adjust the location of the tub back 130 smoothly.

The coupling of the bearing housing with tub back 130 is implemented in a state of the rear surface of the tub back 130 being in close contact with the tub back coupling part 425 of the bearing housing 400. At this time, the rear surface of the tub back 130 is formed correspondingly to the front surface of the tub back coupling part 425 to be in close contact with each other. here, the tub back 130 and the bearing housing 400 are coupled to each other by an auxiliary coupling material (405*a*) passing through the bearing housing 400 from the rear portion, for example, a bolt.

Figure 11:
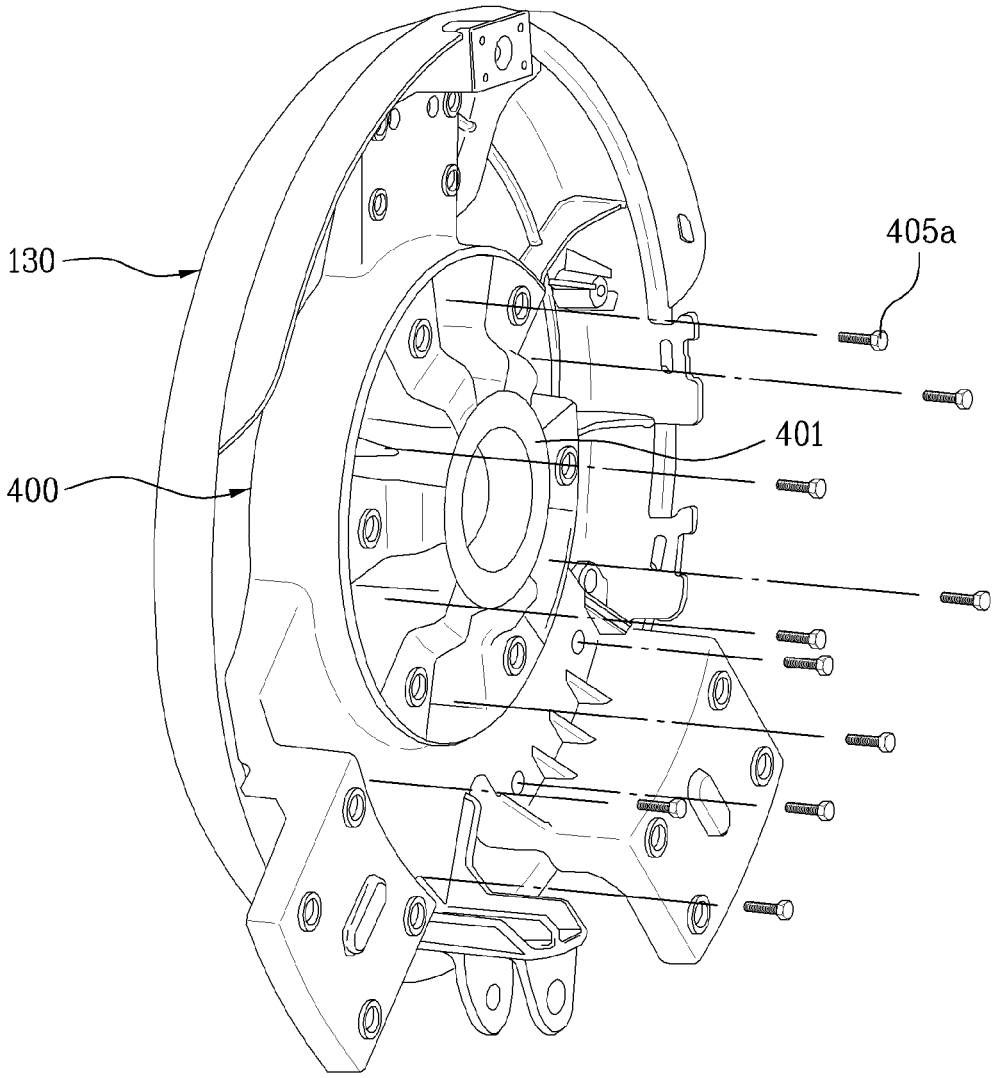
FIG. 11 is a perspective view illustrating a coupling state between the tub back and the bearing housing of the laundry machine according to the present invention.

At this time, the coupling material configured to secure the tub back 130, for example, a bolt and the like may be inserted in one of the tub back coupling holes 405 formed in the tub-back-toward projected one of the middle ribs 421 extended from the bearing supporting part 401, only to secure the tub back 130. That is, the coupling material configured to securely couple the tub back 130 may be inserted more internal than the location of the stator coupling part 402, to securely couple the tub back 130. As a result, when the stator is coupled, the coupling material for the tub back 130 may not interfere with the stator (MS) (see FIG. 11).

In the meanwhile, the tub back coupling holes 405 may be formed outer to the bearing supporting part 401 of the above bearing housing 400 to be coupled with the coupling bosses 138. Auxiliary holes (not shown) may be formed in the first and second extending parts 406*a* and 406*b* of the bearing housing to be coupled to the auxiliary coupling bosses 139, respectively.

In reference to FIG. 10, the stator coupling part will be described. The stator coupling part 402 is formed by the projected portion of the rear surface of the bearing housing 400, which is an opposite surface toward the tub inside out of the middle ribs extended from the bearing supporting part 401.

Six stator coupling bosses 404 are formed in the stator coupling part 402 to couple the stator 80 thereto. The coupling bosses 404 are formed along a circumference of the middle rib 421.

Projected portions of the rear surface of the stator coupling part 420 may be stepped in a radial direction. That is, there may be a predetermined portion extended from the bearing supporting part 401 in a radial direction and another portion bent forward from the extended portion and a further portion re-extended from the bent portion in a radial direction (hereinafter, a rear plane part 409). The reason why the stator coupling part 402 is stepped is that the position of the stator (MS) has to be limited when the stator (MS) is coupled.

The rear plane parts 409 may be placed on the same single plane in a radial direction. The rear plane parts 409 may be portions in which the stator coupling bosses 404 will be located. That is, the stator (MS) may be coupled to the stator coupling bosses 404 formed in the rear plane part 409 by an auxiliary coupling material 404*a*, for example, a bolt and the like. As a result, the coupling position of the tub back 130 mentioned above is different from the coupling position of the stator (MS) such that the coupling of the tub back 130 may not interfere with the coupling of the stator (MS) (see, FIG. 12).

The gentle curvature part 407 having the coupling holes 405 formed therein may be formed in the front surface of the stator coupling part 402 and the rear plane part 409 formed distant from the bearing supporting part 401 in the radial direction may be formed in the rear surface of the stator coupling part 402. Here, an outer circumference of the rear plane part 409 may be identical to or larger than an outer circumference of the front gentle curvature part 407.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry machine comprising:
- a tub to receive wash water;
- a drum rotatably provided in the tub;
- a shaft connected with the drum;
- a bearing housing to rotatably support the shaft;
- a tub back coupled to inner and outer circumferences of a front surface of the bearing housing;
- a motor coupled to a rear portion of the bearing housing;
- a rear gasket connected between the tub back and the tub; and
- a suspension to support vibration of the drum, wherein a stator securing portion configured to secure a stator of the motor to the bearing housing is formed in the rear portion of the bearing housing and is stepped in a radial direction such that a position of the stator is limited when the stator is coupled thereto,
- wherein a through-hole is formed in a center of the tub back and is configured to accommodate the shaft therethrough, wherein a front surface of the tub back projects toward an inside of the tub to form a convex outer surface surrounding the through-hole, and
- wherein the bearing housing includes:
  - a bearing supporting portion configured to support the shaft; and
  - an extended portion that extends from the bearing supporting portion in a radial direction, wherein an inner circumferential portion of the extended portion is coupled with the tub back.

2. The laundry machine as claimed in claim 1, wherein coupling bosses to couple the tub back to the bearing housing are formed on a rear surface of the tub back.

3. The laundry machine as claimed in claim 2, wherein the bearing housing has coupling holes to allow the coupling bosses to be inserted therein.

4. The laundry machine as claimed in claim 1, wherein the extending portion includes first and second extending portions that extend in the radial direction, and wherein auxiliary coupling bosses coupled to the first and second extending portions are formed in an outer circumference of a rear surface of the tub back.

5. The laundry machine as claimed in claim 4, wherein auxiliary coupling holes in which the auxiliary coupling bosses are inserted are formed in the first and second extending portions of the bearing housing, respectively.

6. The laundry machine as claimed in claim 1, wherein ribs configured to reinforce a rigidity of the tub back are formed in a rear surface of the tub back.

7. The laundry machine as claimed in claim 6, wherein the ribs include radial ribs formed in a radial direction and circular ribs formed in a circumferential direction.

8. The laundry machine as claimed in claim 1, wherein the tub back includes an inserting rim that extends toward the inside of the tub along an inner circumferential surface of the through-hole.

9. The laundry machine as claimed in claim 8, wherein a spider includes a recessed portion in which the inserting rim is inserted.

10. The laundry machine as claimed in claim 1, wherein the extended portion is formed to project forward and is recessed backward along a circumferential direction.

11. The laundry machine as claimed in claim 10, wherein the extended portion is coupled with the tub back at the forward-projected portion.

12. The laundry machine as claimed in claim 11, wherein the forward-projected portion is formed in a curved shape having a center that projects toward the tub.

13. The laundry machine as claimed in claim 10, wherein the tub back is coupled to the extended portion by a coupling material that passes through the forward-projected portion.

14. The laundry machine as claimed in claim 13, wherein a height of the recessed portion is larger than a height formed by the coupling material.

15. The laundry machine as claimed in claim 10, wherein the backward-recessed portion includes a boss that extends forward to couple the stator.

16. The laundry machine as claimed in claim 11, wherein the bearing housing further includes an outer circumferential rib that extends in a front to rear direction along at least one of an outer circumferential surface or edge.

17. The laundry machine as claimed in claim 1, wherein the suspension includes an axially-extended bracket that extends in a rotational axis direction of the drum.

* * * * *